US008162618B2

(12) United States Patent
Nakamura et al.

(10) Patent No.: US 8,162,618 B2
(45) Date of Patent: Apr. 24, 2012

(54) METHOD AND DEVICE FOR CONTROLLING PUMP TORQUE FOR HYDRAULIC CONSTRUCTION MACHINE

(75) Inventors: Kazunori Nakamura, Tsuchiura (JP); Yoichi Kowatari, Ibaraki-ken (JP); Kouji Ishikawa, Ibaraki-ken (JP); Yasushi Arai, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 1001 days.

(21) Appl. No.: 10/507,888

(22) PCT Filed: Nov. 18, 2003

(86) PCT No.: PCT/JP03/14638

§ 371 (c)(1),
(2), (4) Date: Sep. 17, 2004

(87) PCT Pub. No.: WO2004/053332

PCT Pub. Date: Jun. 24, 2004

(65) Prior Publication Data

US 2005/0160727 A1 Jul. 28, 2005

(30) Foreign Application Priority Data

Dec. 11, 2002 (JP) ..... 2002-359822

(51) Int. Cl.
*F04B 49/00* (2006.01)
*F16D 31/02* (2006.01)

(52) U.S. Cl. ..... 417/34; 417/53; 417/212; 60/451; 60/452

(58) Field of Classification Search ..... 60/451, 60/452; 417/34, 212, 53
See application file for complete search history.

(56) References Cited

U.S. PATENT DOCUMENTS

| | | | | |
|---|---|---|---|---|
| 4,606,313 | A | 8/1986 | Izumi et al. | |
| 5,951,258 | A * | 9/1999 | Lueschow et al. | 417/22 |
| 6,254,511 | B1 * | 7/2001 | Esterby et al. | 477/143 |
| 2002/0162533 | A1 * | 11/2002 | Houchin et al. | 123/352 |
| 2003/0019681 | A1 * | 1/2003 | Nakamura | 180/307 |

FOREIGN PATENT DOCUMENTS

| | | | |
|---|---|---|---|
| JP | 57-65822 | | 4/1982 |
| JP | 2-115582 | | 4/1990 |
| JP | 3-71182 | | 7/1991 |
| JP | 4-253787 | | 11/1991 |
| JP | 11-101183 | | 4/1999 |
| JP | 2000-73812 | | 3/2000 |
| JP | 2000-73960 | | 3/2000 |
| WO | WO0250435 | * | 6/2002 |

* cited by examiner

*Primary Examiner* — Charles Freay
(74) *Attorney, Agent, or Firm* — Mattingly & Malur, PC

(57) ABSTRACT

A current load rate of an engine 10 is computed and a maximum absorption torque of at least one hydraulic pump 1, 2 is controlled so that the load rate is held at a target value. Engine stalling can be prevented by decreasing the maximum absorption torque of the hydraulic pump under a high-load condition. When an engine output lowers due to environmental changes, the use of poor fuel or other reasons, the maximum absorption torque of the hydraulic pump can be decreased without a lowering of the engine revolution speed. Further, the present invention is adaptable for any kinds of factors causing a lowering of the engine output, such as those factors that cannot be predicted in advance or are difficult to detect by sensors. In addition, because of no necessity of sensors, such as environment sensors, the manufacturing cost can be reduced.

7 Claims, 12 Drawing Sheets

INVENTION

METHOD AND DEVICE FOR CONTROLLING PUMP TORQUE FOR HYDRAULIC CONSTRUCTION MACHINE

TECHNICAL FIELD

The present invention relates to a pump torque control method and system for a hydraulic construction machine in which a diesel engine is installed as a prime mover and a variable displacement hydraulic pump is driven by the engine to drive an actuator.

BACKGROUND ART

Generally, in a hydraulic construction machine such as a hydraulic excavator, a diesel engine is installed as a prime mover and a variable displacement hydraulic pump is driven by the engine to drive an actuator, thereby carrying out predetermined work. Engine control in that type of hydraulic construction machine is generally performed by setting a target fuel injection amount and controlling a fuel injector in accordance with the target fuel injection amount.

Also, control of the hydraulic pump is generally performed as displacement control in accordance with a demanded flow rate and as torque control (horsepower control) in accordance with a pump delivery pressure. In the torque control of the hydraulic pump, by decreasing the displacement of the hydraulic pump as the pump delivery pressure rises, an absorption torque of the hydraulic pump is controlled so as not to exceed a maximum absorption torque set in advance, thereby preventing an overload of the engine.

Speed sensing control disclosed in JP,A 57-65822, for example, is known as a technique for effectively utilizing output horsepower of an engine in the above-mentioned torque control of the hydraulic pump. The disclosed speed sensing control comprises the steps of converting a deviation of an actual revolution speed from a target revolution speed of the engine into a torque modification value, adding or subtracting the torque modification value to or from a pump base torque to obtain a target value of maximum absorption torque, and controlling the maximum absorption torque of a hydraulic pump to be matched with the target value. With the speed sensing control, when the engine revolution speed (actual revolution speed) lowers, the maximum absorption torque of the hydraulic pump is decreased to prevent stalling of the engine. As a result, the maximum absorption torque (setting value) of the hydraulic pump can be set closer to a maximum output torque of the engine and hence output horsepower of the engine can be effectively utilized.

Further, improved techniques of the speed sensing control executed in the torque control of the hydraulic pump are disclosed in JP,A 11-101183, JP,A 2000-73812, JP,A 2000-73960, etc. With those improved techniques, environment factors (such as an atmospheric pressure, a fuel temperature and a cooling water temperature) that affect the engine output are detected by sensors, a modification value of the pump base torque is obtained by referring to preset maps based on the detected values, and the maximum absorption torque of the hydraulic pump is modified in accordance with the modification value. Therefore, even when the engine output lowers due to environmental changes, the maximum absorption torque of the hydraulic pump is decreased by the speed sensing control under a high load condition to prevent stalling of the engine. At the same time, a lowering of the revolution speed of the prime mover caused by the speed sensing control can be made less and satisfactory workability can be ensured.

DISCLOSURE OF INVENTION

However, the above-described prior art has problems as follows.

An output torque characteristic of a diesel engine is divided into a characteristic corresponding to a regulation region (partial load region) and a characteristic corresponding to a full load region. The regulation region is an output region in which the fuel amount injected by a fuel injector is less than 100%, and the full load region is a maximum output torque region in which the fuel injection amount is 100%. The engine output varies depending on environmental changes and engine operation status, including fuel quality, and an engine output characteristic also varies correspondingly.

With the general speed sensing control disclosed in JP,A 57-65822, etc., when the engine output has a sufficient margin and the maximum output torque in the regulation region of the engine output characteristic is larger than the pump base torque (i.e., the maximum absorption torque of the hydraulic pump) in the speed sensing control, a matching point between the engine output torque and the pump absorption torque in the speed sensing control locates within the regulation region under a high-load condition. Therefore, the engine revolution speed is matched with the target revolution speed, and the maximum absorption torque of the hydraulic pump can be decreased so as to prevent stalling of the engine without a lowering of the engine revolution speed. When the engine output lowers due to a decrease of the intake air amount (environmental change), the use of poor fuel, etc. and the maximum output torque in the regulation region of the engine output characteristic becomes smaller than the pump base torque (i.e., the maximum absorption torque of the hydraulic pump) in the speed sensing control, the maximum absorption torque of the hydraulic pump is controlled so as to decrease by the speed sensing control. At this time, however, the matching point between the engine output torque and the pump absorption torque shifts from the regulation region to the full load region, whereby the engine revolution speed lowers from the target revolution speed. Accordingly, whenever such a shift occurs during work in which the load condition changes to the high-load condition. e.g., work of excavating earth and sand, the engine revolution speed lowers, thus generating noise and making an operator feel unpleasant or fatigue.

With the speed sensing control disclosed in JP,A 11-101183, JP,A 2000-73812, JP,A 2000-73960, etc., the pump base torque is modified in response to a lowering of the engine output caused by changes of the environment factors detected by the sensors, such as the atmospheric pressure, the fuel temperature and the cooling water temperature, so that the lowering of the engine revolution speed caused by the speed sensing control can be prevented. However, because those known techniques employ the sensors provided in prediction of various environment factors in advance and utilize values detected by the sensors, they are not adaptable for a lowering of the engine output attributable to environment factors which cannot be predicted in advance. Also, those known techniques are not adaptable for a lowering of the engine output attributable to other factors, e.g., the use of poor fuel, which are difficult to detect by sensors. Further, many sensors are required to detect the various environment factors, and maps in the same number as the sensors must be prepared and installed in a controller, thus resulting in an increased cost.

An object of the present invention is to provide a pump torque control method and system for a hydraulic construction machine, which can prevent stalling of an engine by decreasing a maximum absorption torque of a hydraulic pump under a high-load condition, which can decrease the maximum absorption torque of the hydraulic pump without a lowering of an engine revolution speed when an engine output has lowered due to environmental changes, the use of poor fuel or other reasons, which is adaptable for any kinds of factors causing a lowering of the engine output, such as those factors that cannot be predicted in advance or are difficult to detect by sensors, and which can be manufactured at a reduced cost because of no necessity of sensors, such as environment sensors.

(1) To achieve the above object, the present invention provides a pump torque control method for a hydraulic construction machine comprising an engine, a fuel injector for controlling a revolution speed and an output of the engine, a fuel injector controller for controlling the fuel injector, and at least one variable displacement hydraulic pump driven by the engine and driving actuators, wherein the control method comprises the steps of computing a current load rate of the engine and controlling a maximum absorption torque of the hydraulic pump so that the load rate is held at a target value.

With those features, when the engine load rate is going to exceed the target value under a high-load condition, the maximum absorption torque of the hydraulic pump is controlled so that the engine load rate is held at the target value. Therefore, under the high-load condition, engine stalling can be prevented by decreasing the maximum absorption torque of the hydraulic pump.

Also, in the event of the engine output being lowered due to environmental changes, the use of poor fuel or other reasons, when the engine load rate is going to exceed the target value under the high-load condition, the maximum absorption torque of the hydraulic pump is also controlled so that the engine load rate is held at the target value. Therefore, the maximum absorption torque of the hydraulic pump can be decreased without a lowering of the engine revolution speed.

Further, because of the control holding the engine load rate at the target value, the control is performed regardless of a factor causing the lowering of the engine output such that, when the maximum output torque in the regulation region lowers, the maximum absorption torque of the hydraulic pump, i.e., the load, can also be automatically decreased. Therefore, the control method is adaptable for the lowering of the engine revolution speed caused by any kinds of factors that cannot be predicted in advance or are difficult to detect by sensors. Additionally, because of no necessity of sensors, such as environment sensors, the manufacturing cost can be reduced.

(2) In above (1), preferably, the step of computing the load rate is performed by setting in advance a relationship between a target fuel injection amount computed by the fuel injector controller and an engine torque margin rate, and determining the load rate as the engine torque margin rate corresponding to the target fuel injection amount at that time.

With those features, the current load rate of the engine can be computed using the target fuel injection amount computed by the fuel injector controller.

(3) Also, in above (1), preferably, the step of controlling the maximum absorption torque is performed by computing a deviation of the load rate from the target value thereof, modifying a pump base torque based on the computed deviation, and controlling the maximum absorption torque of the hydraulic pump to be matched with a modified pump base torque.

With those features, the maximum absorption torque of the hydraulic pump can be controlled so that the current load rate of the engine is held at the target value.

(4) Further, in above (1) to (3), the pump torque control method of the present invention preferably further comprises the steps of, at the same time as controlling the maximum absorption torque of the hydraulic pump so that the load rate is held at the target value thereof, computing a deviation of an actual revolution speed from a target revolution speed of the engine, and controlling the maximum absorption torque of the hydraulic pump so that the deviation reduces.

With those features, the maximum absorption torque of the hydraulic pump can be controlled by combination of both the control according to the present invention and the known speed sensing control. Therefore, a control response can be improved even when an abrupt load is applied.

(5) Also, to achieve the above object, the present invention provides a pump torque control system for a hydraulic construction machine comprising an engine, a fuel injector for controlling a revolution speed and an output of the engine, a fuel injector controller for controlling the fuel injector, and at least one variable displacement hydraulic pump driven by the engine and driving actuators, wherein the control system further comprises first means for computing a current load rate of the engine, and second means for controlling a maximum absorption torque of the hydraulic pump so that the load rate is held at a target value.

With those features, similarly to above-described (1), engine stalling can be prevented by decreasing the maximum absorption torque of the hydraulic pump under the high-load condition. When the engine output lowers due to environmental changes, the use of poor fuel or other reasons, the maximum absorption torque of the hydraulic pump can be decreased without a lowering of the engine revolution speed. Further, the control system is adaptable for any kinds of factors causing the lowering of the engine revolution speed, such as those factors that cannot be predicted in advance or are difficult to detect by sensors. Additionally, because of no necessity of sensors, such as environment sensors, the manufacturing cost can be reduced.

(6) In above (5), preferably, the first means sets in advance a relationship between a target fuel injection amount computed by the fuel injector controller and an engine torque margin rate, and determines the load rate as the engine torque margin rate corresponding to the target fuel injection amount at that time.

With those features, the current load rate of the engine can be computed using the target fuel injection amount computed by the fuel injector controller.

(7) Also, in above (5), preferably, the second means compute a deviation of the load rate from the target value thereof, modifies a pump base torque based on the computed deviation, and controls the maximum absorption torque of the hydraulic pump to be matched with a modified pump base torque.

With those features, the maximum absorption torque of the hydraulic pump can be controlled so that the current load rate of the engine is held at the target value.

(8) In above (7), preferably, the second means integrate the deviation to determine a pump base torque modification value, and add the determined pump base torque modification value to the pump base torque, thereby modifying the pump base torque.

With those features, the pump base torque can be modified using the deviation of the load rate from the target value thereof.

(9) Further, in above (5) to (8), the pump torque control system preferably further comprises third means for computing a deviation of an actual revolution speed from a target revolution speed of the engine, and controlling the maximum absorption torque of the hydraulic pump so that the deviation reduces.

With those features, the maximum absorption torque of the hydraulic pump can be controlled by combination of both the control according to the present invention and the known speed sensing control. Therefore, a control response can be improved even when an abrupt load is applied.

BEST MODE FOR CARRYING OUT THE INVENTION

Embodiments of the present invention will be described below with reference to the drawings. In the following embodiments, the present invention is applied to an engine/pump control unit for a hydraulic excavator.

A first embodiment of the present invention will be first described with reference to FIGS. 1 to 8.

Figure 1:
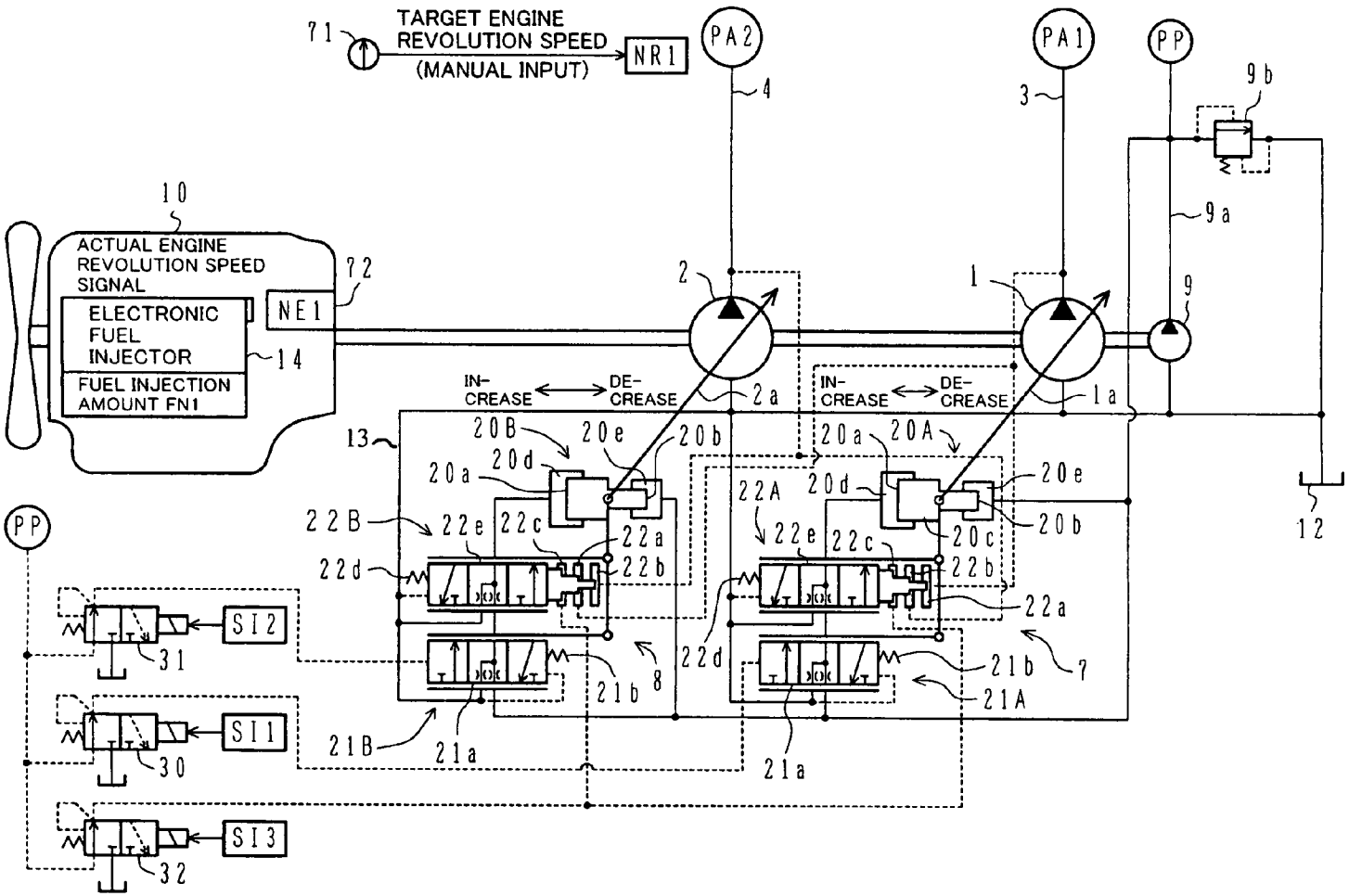
FIG. 1 is a diagram showing an engine/pump control unit including a pump torque control system for a hydraulic construction machine according to a first embodiment of the present invention.

In FIG. 1, reference numerals 1 and 2 denote variable displacement hydraulic pumps of, e.g., swash plate type. Numeral 9 denotes a fixed displacement pilot pump. The hydraulic pumps 1, 2 and the pilot pump 9 are connected to an output shaft 11 of a prime mover 10 and are driven by the prime mover 10 for rotation.

Figure 2:
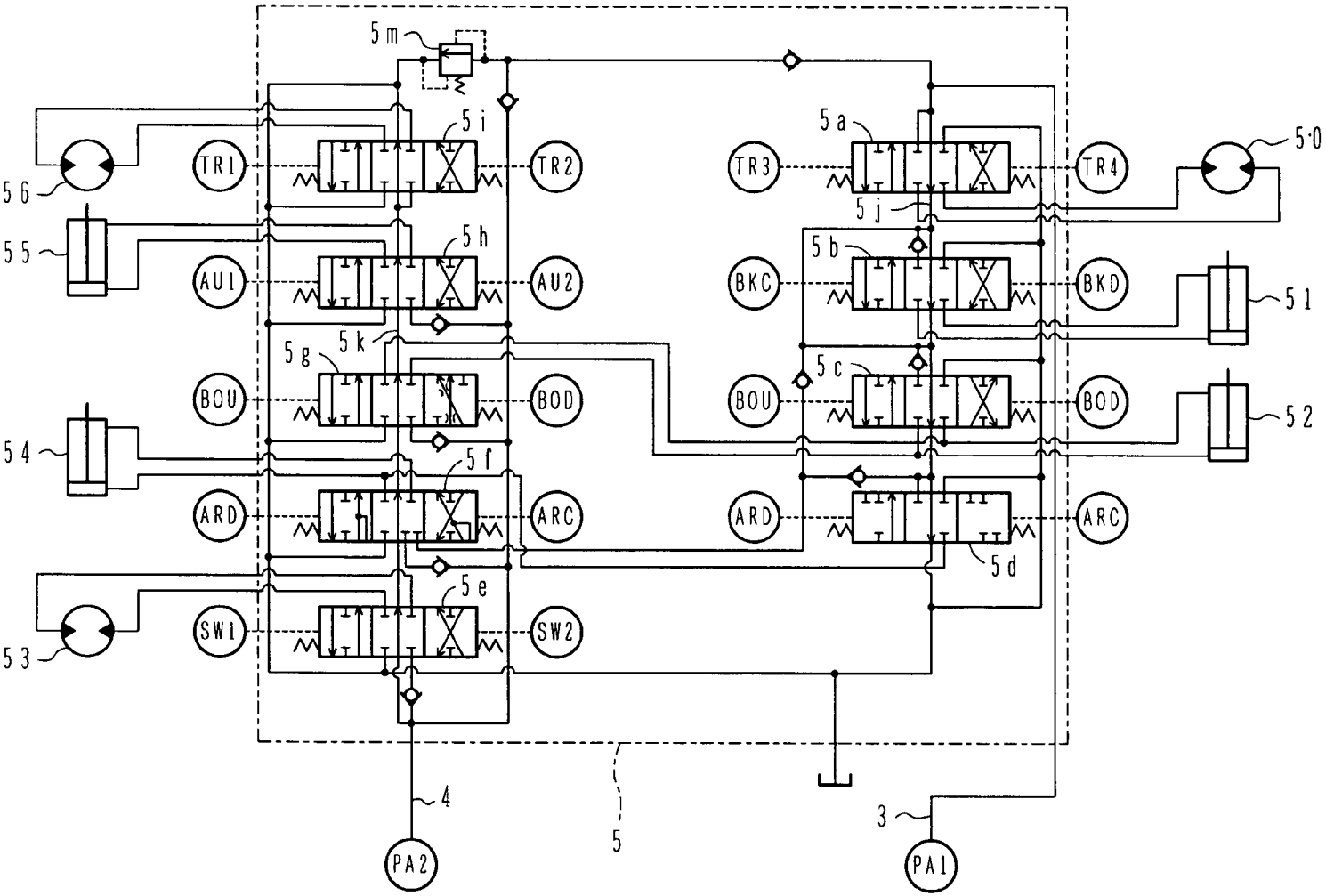
FIG. 2 is a hydraulic circuit diagram of a valve unit and actuators.

A valve unit 5, shown in FIG. 2, is connected to delivery lines 3, 4 of the hydraulic pumps 1, 2. A hydraulic fluid is supplied to a plurality of actuators 50 to 56 through the valve unit 5, thereby driving the actuators. A pilot relief valve 9*b* for holding the delivery pressure of the pilot pump 9 at a certain pressure is connected to a delivery line 9*a* of the pilot pump 9.

Details of the valve unit 5 will be described below.

In FIG. 2, the valve unit 5 has two valve groups comprising respectively flow control valves 5*a*-5*d* and flow control valves 5*e*-5*i*. The flow control valves 5*a*-5*d* are positioned on a center bypass line 5*j* connected to the delivery line 3 of the hydraulic pump 1, and the flow control valves 5*e*-5*i* are positioned on a center bypass line 5*k* connected to the delivery line 4 of the hydraulic pump 2. A main relief valve 5*m* for deciding a maximum value of the delivery pressure of the hydraulic pumps 1, 2 is disposed in the delivery lines 3, 4.

The flow control valves 5*a*-5*d* and the flow control valves 5*e*-5*i* are each of the center bypass type. The hydraulic fluid delivered from the hydraulic pumps 1, 2 is supplied to corresponding one or more of the actuators 50-56 through the associated flow control valves. The actuator 50 is a hydraulic motor for travel on the right side (i.e., a right travel motor), and the actuator 51 is a hydraulic cylinder for a bucket (i.e., a bucket cylinder). The actuator 52 is a hydraulic cylinder for a boom (i.e., a boom cylinder), and the actuator 53 is a hydraulic motor for swing (i.e., a swing motor). The actuator 54 is a hydraulic cylinder for an arm (i.e., an arm cylinder), the actuator 55 is a backup hydraulic cylinder, and the actuator 56 is a hydraulic motor for travel on the left side (i.e., a left travel motor). The flow control valve 5*a* serves for travel on the right side, and the flow control valve 5*b* serves for the bucket. The flow control valve 5*c* serves for a first boom, and the flow control valve 5*d* serves for a second arm. The flow control valve 5*e* serves for swing, the flow control valve 5*f* serves for a first arm, and the flow control valve 5*g* serves for a second boom. The flow control valve 5*h* serves for backup, and the flow control valve 5*i* serves for travel on the left side. Stated another way, two flow control valves 5*g*, 5*c* are disposed in association with the boom cylinder 52 and two flow control valves 5*d*, 5*f* are disposed in association with the arm cylinder 54, whereby respective hydraulic fluids from the two hydraulic pumps 1, 2 can be supplied in a joined way to the bottom side of each of the boom cylinder 52 and the arm cylinder 54.

Figure 3:
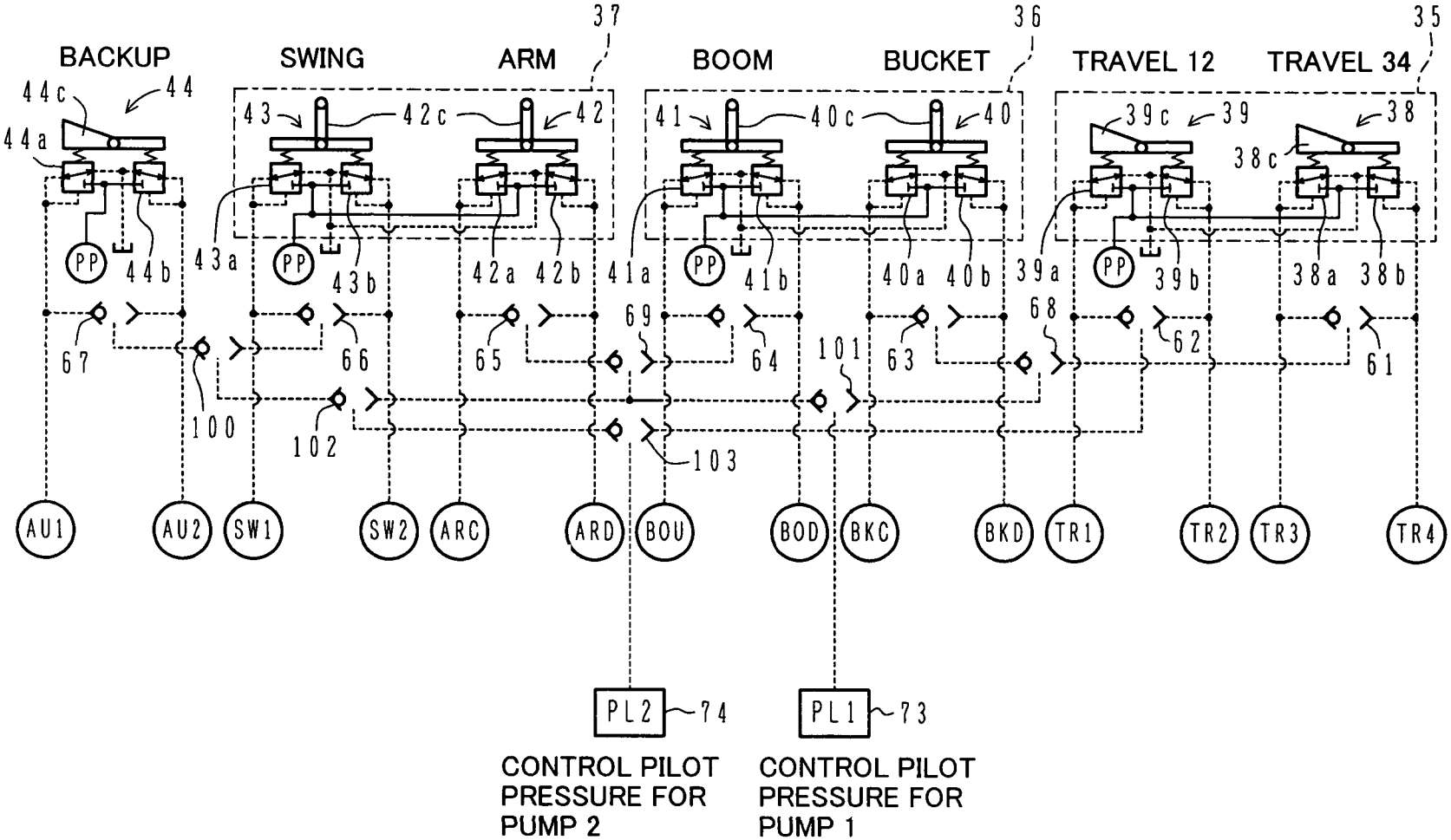
FIG. 3 is a diagram showing an operation pilot system for flow control valves.

FIG. 3 shows an operation pilot system for the flow control valves 5*a*-5*i*.

The flow control valves 5*i*, 5*a* are operated for shift by operation pilot pressures TR1, TR2; TR3, TR4 produced from operation pilot devices 39, 38 of an operating unit 35. The flow control valve 5*b* and the flow control valves 5*c*, 5*g* are operated for shift by operation pilot pressures BKC, BKD; BOD, BOU produced from operation pilot devices 40, 41 of an operating unit 36. The flow control valves 5*d*, 5*f* and the flow control valve 5*e* are operated for shift by operation pilot pressures ARC, ARD; SW1, SW2 produced from operation pilot devices 42, 43 of an operating unit 37. The flow control valve 5*h* is operated for shift by operation pilot pressures AU1, AU2 produced from an operation pilot device 44.

The operation pilot devices 38-44 have pairs of pilot valves (pressure reducing valves) 38*a*, 38*b*-44*a*, 44*b*, respectively. Further, the operation pilot devices 38, 39 and 44 have control pedals 38*c*, 39*c* and 44*c*, respectively. The operation pilot devices 40, 41 have a common control lever 40*c*, and the operation pilot devices 42, 43 have a common control lever 42*c*. When any of the control pedals 38*c*, 39*c* and 44*c* and the control levers 40*c*, 42*c* is manipulated, the pilot valve of the associated operation pilot device corresponding to the direction of the manipulation is operated and an operation pilot pressure is produced depending on an input amount by which the control pedal or lever is manipulated.

Shuttle valves 61-67, shuttle valves 68, 69 and 100, shuttle valves 101, 102, and a shuttle valve 103 are connected in a hierarchical arrangement to output lines of the respective pilot valves of the operation pilot devices 38-44. The shuttle valves 61, 63, 64, 65, 68, 69 and 101 cooperate to detect a maximum one of the operation pilot pressures from the operation pilot devices 38, 40, 41 and 42 as a control pilot pressure PL1 for the hydraulic pump 1, whereas the shuttle valves 62, 64, 65, 66, 67, 69, 100, 102 and 103 cooperate to detect a maximum one of the operation pilot pressures from the operation pilot devices 39, 41, 42, 43 and 44 as a control pilot pressure PL2 for the hydraulic pump 2.

The engine/pump control unit including the pump torque control system of the present invention is employed in the hydraulic drive system thus constructed. Details of the engine/pump control unit will be described below.

In FIG. 1, the hydraulic pumps 1, 2 are provided with regulators 7, 8, respectively. The regulators 7, 8 regulate tilting positions of swash plates 1*a*, 2*a*, i.e., displacement varying mechanisms of the hydraulic pumps 1, 2, thereby to control respective pump delivery rates.

The regulators 7, 8 for the hydraulic pumps 1, 2 comprise respectively tilting actuators 20A, 20B (hereinafter represented by 20 as required), first servo valves 21A, 21B (hereinafter represented by 21 as required) for performing positive tilting control in accordance with the operation pilot pressures from the operation pilot devices 38-44 shown in FIG. 3, and second servo valves 22A, 22B (hereinafter represented by 22 as required) for performing total horsepower control of the hydraulic pumps 1, 2. Those servo valves 21, 22 control the pressure of a hydraulic fluid supplied from the pilot pump 9 and acting upon the respective tilting actuators 20, thereby controlling the tilting positions of the hydraulic pumps 1, 2.

Details of the tilting actuators 20 and the first and second servo valves 21, 22 will be described below.

Each tilting actuator 20 comprises an working piston 20*c* having a large-diameter pressure bearing portion 20*a* and a small-diameter pressure bearing portion 20*b* formed at opposite ends thereof, and a large-diameter pressure bearing chamber 20*d* and a small-diameter pressure bearing chamber 20*e* in which the pressure bearing portions 20*a*, 20*b* are positioned respectively. When the pressures in both the pressure bearing chambers 20*d*, 20*e* are equal to each other, the working piston 20*c* is moved to the right, as viewed in FIG. 1, due to a difference of pressure bearing area, whereupon the tilting of the swash plate 1*a* or 2*a* is reduced to decrease the pump delivery rate. When the pressure in the large-diameter pressure bearing chamber 20*d* lowers, the working piston 20*c* is moved to the left, as viewed in FIG. 1, whereupon the tilting of the swash plate 1*a* or 2*a* is enlarged to increase the pump delivery rate. Further, the large-diameter pressure bearing chamber 20*d* is selectively connected through the first and second servo valves 21, 22 to one of the delivery line 9*a* of the pilot pump 9 and a return fluid line 13 leading to a reservoir 12. The small-diameter pressure bearing chamber 20*e* is directly connected to the delivery line 9*a* of the pilot pump 9.

Each first servo valve 21 for the positive tilting control is a valve operated by a control pressure from a solenoid control valve 30 or 31 to control the tilting position of the hydraulic pump 1 or 2. When the control pressure is low, a valve member 21*a* of the servo valve 21 is moved to the left, as viewed in FIG. 1, by the force of a spring 21*b*, whereupon the large-diameter pressure bearing chamber 20*d* of the tilting actuator 20 is communicated with the reservoir 12 via the return fluid line 13 to increase the tilting of the hydraulic pump 1 or 2. When the control pressure rises, the valve member 21*a* of the servo valve 21 is moved to the right, as viewed in FIG. 1, whereupon the pilot pressure from the pilot pump 9 is introduced to the large-diameter pressure bearing chamber 20*d* to decrease the tilting of the hydraulic pump 1 or 2.

Each second servo valve 22 for the total horsepower control is a valve operated by the delivery pressure of the hydraulic pump 1 or 2 and a control pressure from a solenoid control valve 32 to perform the total horsepower control of the hydraulic pump 1 or 2. In other words, the second servo valve 22 controls a maximum absorption torque of the hydraulic pump 1 or 2 in accordance with the control pressure from the solenoid control valve 32.

More specifically, the delivery pressures of the hydraulic pumps 1, 2 and the control pressure from the solenoid control valve 32 are introduced respectively to pressure bearing chambers 22*a*, 22*b* and 22*c* of the second servo valve 22. When the sum of hydraulic forces of the delivery pressures of the hydraulic pumps 1, 2 and the control pressure from the solenoid control valve 32 is smaller than a setting value that is determined depending on a difference between a force of a spring 22*d* and a hydraulic force of the control pressure introduced to the pressure bearing chamber 22*c*, a valve member 22*e* is moved to the right, as viewed in FIG. 1 whereupon the large-diameter pressure bearing chamber 20*d* of the tilting actuator 20 is communicated with the reservoir 12 via the return fluid line 13 to increase the tilting of the hydraulic pump 1 or 2. As the sum of the hydraulic forces of the delivery pressures of the hydraulic pumps 1, 2 increases in excess of the above-mentioned setting value, the valve member 22*e* is moved to the left, as viewed in FIG. 1, whereupon the pilot pressure from the pilot pump 9 is transmitted to the pressure bearing chamber 20*d* to decrease the tilting of the hydraulic pump 1 or 2. Further, when the control pressure from the solenoid control valve 32 is low, the above-mentioned setting value is increased so that the tilting of the hydraulic pump 1 or 2 starts to decrease from a relatively high delivery pressure of the hydraulic pump 1 or 2. As the control pressure from the solenoid control valve 32 rises, the above-mentioned setting value is reduced so that the tilting of the hydraulic pump 1 or 2 starts to decrease from a relatively low delivery pressure of the hydraulic pump 1 or 2.

Figure 4:
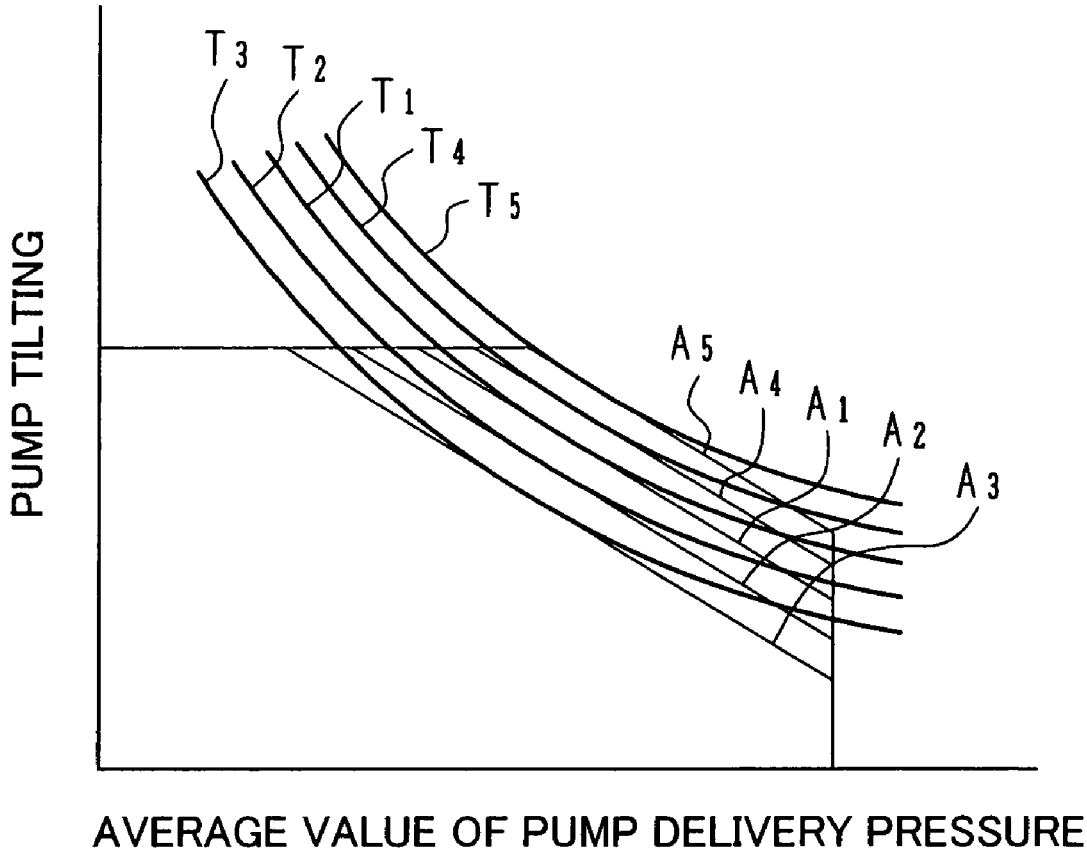
FIG. 4 is a graph showing control characteristics of pump absorption torque obtained by a second servo valve of a pump regulator.

FIG. 4 shows characteristics of absorption torque control performed by the second servo valve 22. In FIG. 4, the horizontal axis represents an average value of the delivery pressures of the hydraulic pumps 1, 2, and the vertical axis represents the tilting (displacement) of the hydraulic pump 1 or 2. As the control pressure from the solenoid control valve 32 rises (i.e., as the setting value determined depending on the difference between the force of the spring 22*d* and the hydraulic force introduced to the pressure bearing chamber 22*c* reduces), an absorption torque characteristic of the second servo valve 22 changes as indicated by A1, A2 and A3 in this order, and a maximum absorption torque of the hydraulic pump 1 or 2 changes as indicated by T1, T2 and T3 in this order. Also, as the control pressure from the solenoid control valve 32 lowers (i.e., as the setting value determined depending on the difference between the force of the spring 22*d* and the hydraulic force introduced to the pressure bearing chamber 22*c* increases), the absorption torque characteristic of the second servo valve 22 changes as indicated by A1, A4 and A5 in this order, and the maximum absorption torque of the hydraulic pump 1 or 2 changes as indicated by T1, T4 and T5 in this order. In other words, by raising the control pressure to reduce the setting value, the maximum absorption torque of the hydraulic pump 1 or 2 decreases, and by lowering the control pressure to increase the setting value, the maximum absorption torque of the hydraulic pump 1 or 2 increases.

The solenoid control valves 30, 31 and 32 are proportional pressure reducing valves operated by drive currents SI1, SI2 and SI3, respectively. The solenoid control valves 30, 31 and 32 operate so as to maximize output control pressures when the drive currents SI1, SI2 and SI3 are minimum, and to lower the output control pressures as the drive currents SI1, SI2 and SI3 increase. The drive currents SI1, SI2 and SI3 are outputted from a machine body controller 70 shown in FIG. 5.

The prime mover 10 is a diesel engine and includes an electronic fuel injector 14 operated in response to a signal indicating a target fuel injection amount FN1. The command signal is outputted from a fuel injector controller 80 shown in FIG. 5. The electronic fuel injector 14 controls the revolution speed and output of the prime mover (hereinafter referred to as an "engine") 10.

There is provided a target engine revolution speed input unit 71 through which the operator manually inputs a target revolution speed NR1 for the engine 10. An input signal indicating the target revolution speed NR1 is taken into the machine body controller 70 and the engine fuel injector controller 80. The target engine revolution speed input unit 71 is an electrical input means, such as a potentiometer, and the operator instructs a target revolution speed as a reference (i.e., a target reference revolution speed).

Further, there are provided a revolution speed sensor 72 for detecting an actual revolution speed NE1 of the engine 10, and pressure sensors 73, 74 (see FIG. 3) for detecting the control pilot pressures PL1, PL2 for the hydraulic pumps 1, 2, respectively.

Figure 5:
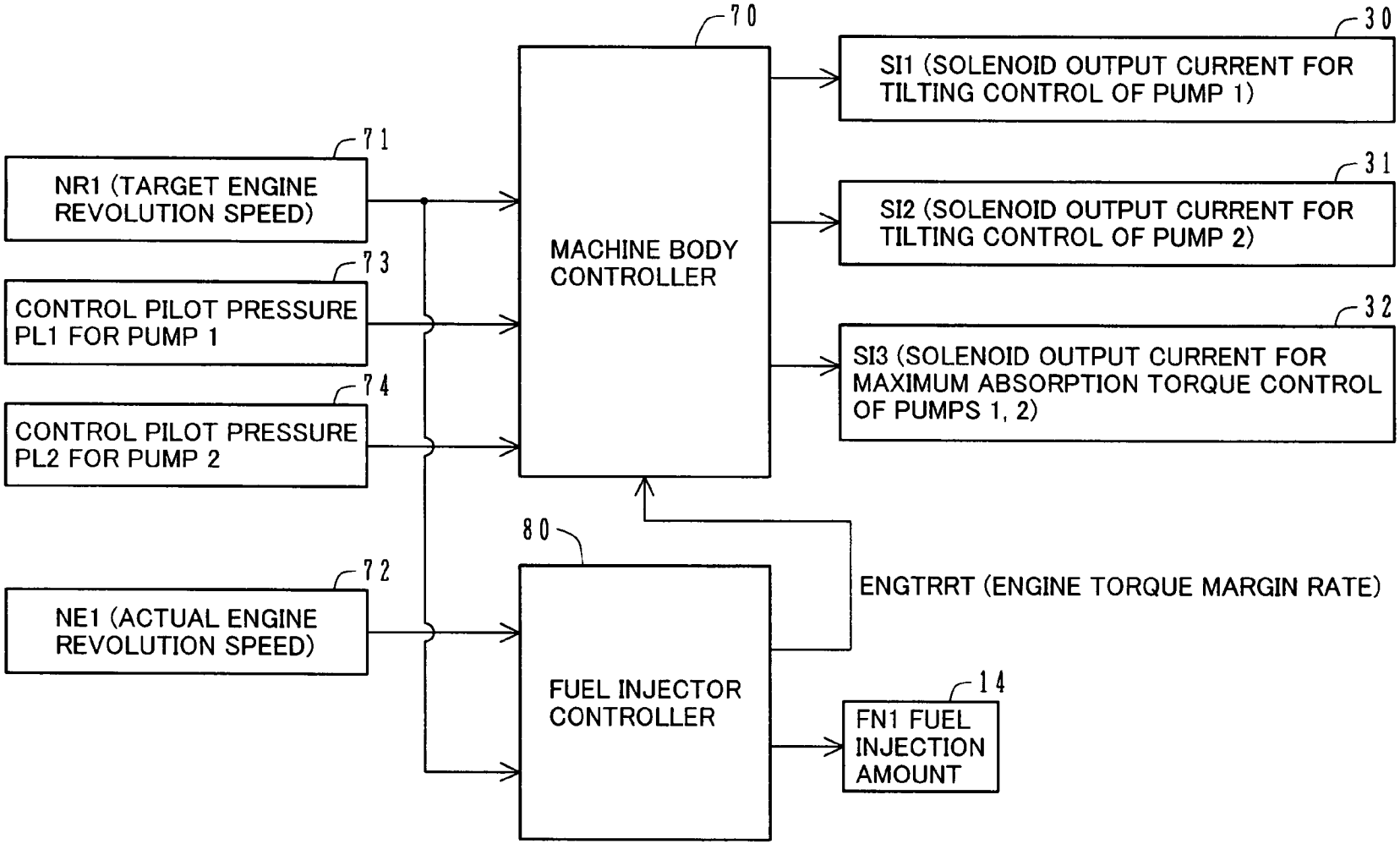
FIG. 5 is a block diagram showing controllers (machine body controller and engine fuel injector controller), which constitute an arithmetic control section of the engine/pump control unit, and input/output relationships of those controllers.

FIG. 5 shows input/output relationships of all signals to and from the machine body controller 70 and the fuel injector controller 80.

The machine body controller 70 receives a signal indicating the target revolution speed NR1 from the target engine revolution speed input unit 71, signals indicating the pump control pilot pressures PL1, PL2 from the pressure sensors 73, 74, and a signal indicating an engine torque margin rate ENGTRRT computed by the engine fuel injector controller 80, and after executing predetermined arithmetic processing based on those input signals, it outputs the drive currents SI1, SI2 and SI3 to the solenoid control valves 30-32. The engine fuel injector controller 80 receives the signal indicating the target revolution speed NR1 from the target engine revolution speed input unit 71 and a signal indicating the actual revolution speed NE1 from the revolution speed sensor 72, and after executing predetermined arithmetic processing based on those input signals, it outputs a signal indicating the target fuel injection amount FN1 to the electronic fuel injector 14. Also, the engine fuel injector controller 80 computes the engine torque margin rate ENGTRRT and outputs the computed signal to the machine body controller 70.

Here, the engine torque margin rate ENGTRRT means an index value of an engine load rate representing what value the current load rate of the engine 10 takes, and it is computed based on the target fuel injection amount FN1 (as described later).

Figure 6:
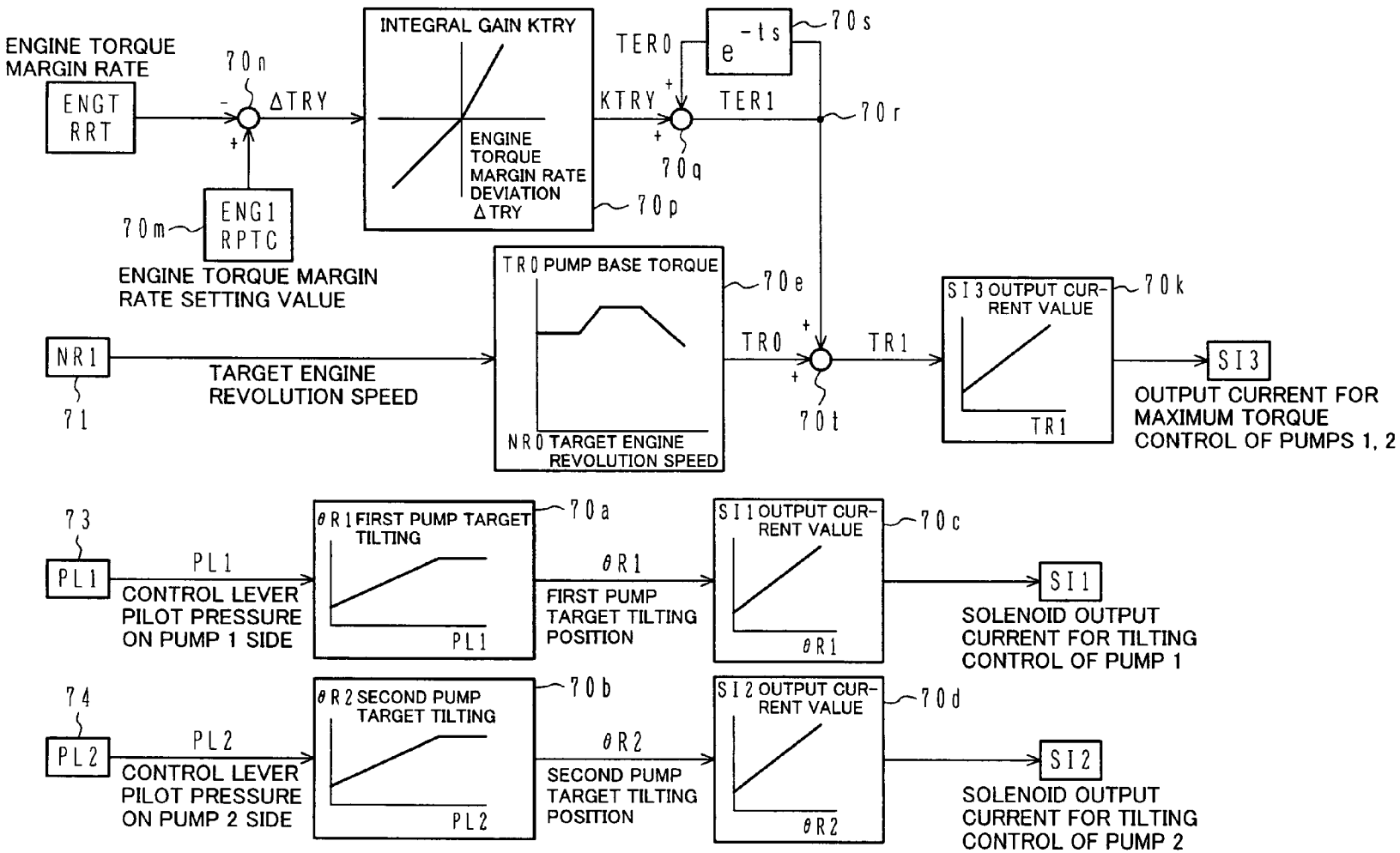
FIG. 6 is a functional block diagram showing processing functions of the machine body controller.

FIG. 6 shows processing functions of the machine body controller 70 in relation to control of the hydraulic pumps 1, 2.

Referring to FIG. 6, the machine body controller 70 has various functions executed by pump target tilting computing units 70*a*, 70*b*, solenoid output current computing units 70*c*, 70*d*, a base torque computing unit 70*e*, an engine torque margin rate setting unit 70*m*, an engine torque margin-rate deviation computing unit 70*n*, a gain computing unit 70*p*, pump torque modification-value computing integral elements 70*q*, 70*r* and 70*s*, a pump base torque modifying unit 70*t*, and a solenoid output current computing unit 70*k*.

The pump target tilting computing unit 70*a* receives the signal indicating the control pilot pressure PL1 on the side of the hydraulic pump 1 and computes a target tilting OR1 of the hydraulic pump 1 corresponding to the control pilot pressure PL1 at that time by referring to a table, which is stored in a memory, based on the input signal. The computed target tilting OR1 is a basis of reference flow rate metering for the positive tilting control with respect to the input amounts by which the pilot operation devices 38, 40, 41 and 42 are manipulated. The table stored in the memory sets therein the relationship between PL1 and θR1 such that, as the control pilot pressure PL1 rises, the target tilting θR1 is also increased.

The solenoid output current computing unit 70*c* determines, for the computed θR1, the drive current SI1 for the tilting control of the hydraulic pump 1, at which that θR1 is obtained, and then outputs the determined drive current SI1 to the solenoid control valve 30.

Also, in the pump target tilting computing unit 70*b* and the solenoid output current computing unit 70*d*, the drive current SI2 for the tilting control of the hydraulic pump 2 is computed from the signal indicating the pump control pilot pressure PL2, and then outputted to the solenoid control valve 31 in a similar manner.

The base torque computing unit 70*e* receives the signal indicating the target revolution speed NR1 and computes a pump base torque TR0 corresponding to the target revolution speed NR1 at that time by referring to a table, which is stored in a memory, based on the input signal. The computed pump base torque TR0 is a reference torque resulting when the engine torque margin rate ENGTRRT computed by the fuel injector controller 80 is equal to a setting value ENG1RPTC (described later). The table stored in the memory sets therein the relationship between the target revolution speed NR1 and the pump base torque (reference torque) TR0 corresponding to change of the maximum output characteristic in the full load region of the engine 10. The reference torque means an engine output torque resulting when the engine 10 has a reference output torque characteristic and the environment (including fuel quality) to which the engine 10 is subjected is in a reference condition. For example, the pump base torque TR0 resulting at maximum setting of the target revolution speed NR1 corresponds to the maximum absorption torque T1 of the hydraulic pump 1, 2, shown in FIG. 4. Although the engine output various depending on situations, the present invention is intended to compensate for such a change of the engine output. Therefore, the reference torque is not required to have high precision and accuracy in a strict sense.

The engine torque margin rate setting unit 70*m* sets therein the setting value ENG1RPTC of the engine torque margin rate. The setting value ENG1RPTC of the engine torque margin rate is a target margin rate with respect to an allowable pump load (engine load) imposed on the engine 10 (as described later). To effectively employ the engine output, the setting value ENG1RPTC is preferably a value close to 100%, e.g., 99%.

The engine torque margin-rate deviation computing unit 70*n* subtracts the engine torque margin rate ENGTRRT, which is computed by the fuel injector controller 80, from the setting value ENG1RPTC set in the setting unit 70*m*, thereby to compute a deviation ΔTRY (=ENG1RPTC−ENGTRRT) between them.

The gain computing unit 70*p* computes an integral gain KTRY in pump base torque varying control according to the present invention by referring to a table, which is stored in a memory, based on the deviation ΔTRY obtained in the engine torque margin-rate deviation computing unit 70*n*. The computed integral gain KTRY is to set a control speed in the present invention. The table stored in the memory sets therein the relationship between ΔTRY and KTRY to make the control gain on the plus (+) side larger than that on the minus (−) side in order that the pump torque (engine load) is quickly reduced when the engine torque margin rate ENGTRRT exceeds the setting value ENG1RPTC (i.e., when the deviation ΔTRY is minus).

The pump torque modification-value computing integral elements 70*q*, 70*r* and 70*s* cooperatively add the integral gain KTRY to a pump base torque modification value TER0, which has been calculated in a preceding cycle, for integration to compute a pump base torque modification value TER1.

The pump base torque modifying unit 70*t* adds the pump base torque modification value TER1 to the pump base torque TR0 computed by the base torque computing unit 70*e*, thereby computing a modified pump base torque TR1 (=TR0+TER1). This modified pump base torque is used as a target value of the pump maximum absorption torque set in the second servo valve 22 for the total horsepower control.

The solenoid output current computing unit 70*k* determines the drive current SI3 for the solenoid control valve 32, at which the maximum absorption torque of the hydraulic pump 1, 2 controlled by the second servo valve 22 becomes TR1, and then outputs the determined drive current SI3 to the solenoid control valve 32.

The solenoid control valve 32 having received the drive current SI3 in such a way outputs a control pressure corresponding to the received drive current SI3 and controls the setting value in the second servo valve 22, thereby controlling the maximum absorption torque of the hydraulic pump 1, 2 to be TR1.

Figure 7:
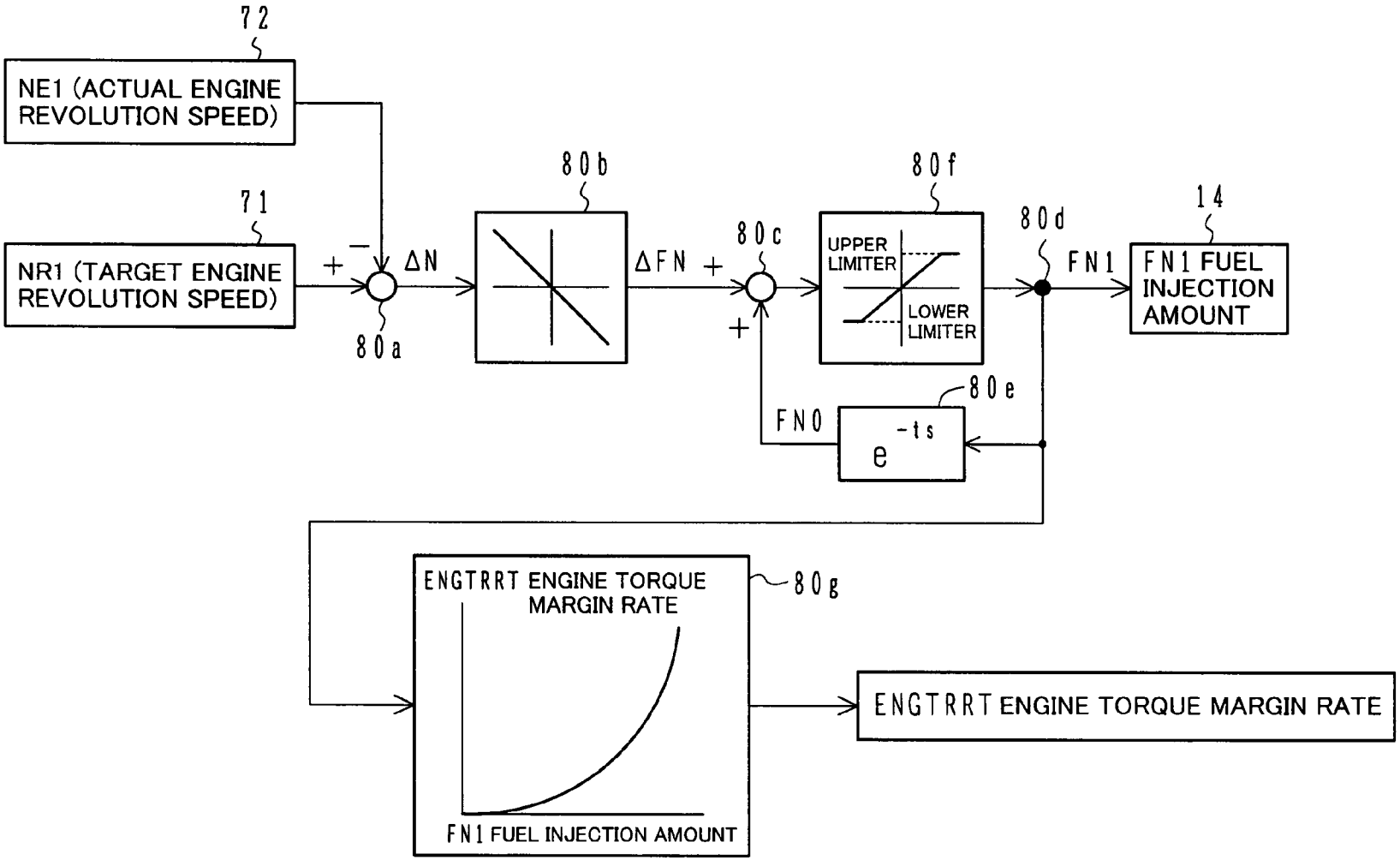
FIG. 7 is a functional block diagram showing processing functions of the fuel injector controller.

FIG. 7 shows processing functions of the fuel injector controller 80.

The fuel injector controller 80 has control functions executed by a revolution speed deviation computing unit 80*a*, a fuel injection amount converting unit 80*b*, integral computing elements 80*c*, 80*d* and 80*e*, a limiter computing unit 80*f*, and an engine torque margin rate computing unit 80*g*.

The revolution speed deviation computing unit 80*a* compares the target revolution speed NR1 and the actual revolution speed NE1 to obtain a revolution speed deviation ΔN (=NR1−NE1), and the fuel injection amount converting unit 80*b* multiplies the revolution speed deviation ΔN by a gain KF to compute an increment ΔFN of the target fuel injection amount. The integral computing elements 80*c*, 80*d* and 80*e* cooperatively add the increment ΔFN of the target fuel injection amount to the target fuel injection amount FN0, which has been calculated in a preceding cycle, for integration to compute a target fuel injection amount FN2. The limiter computing unit 80*f* multiplies the target fuel injection amount FN2 by upper and lower limiters to obtain a target fuel injection amount FN1. This target fuel injection amount FN1 is sent to an output unit (not shown) from which a corresponding control current is outputted to the electronic fuel injector 14, thereby controlling the fuel injection amount. With such an arrangement, the target fuel injection amount FN1 is computed with the integral operation such that when the actual revolution speed NE1 is lower than the target revolution speed NR1 (i.e., when the revolution speed deviation ΔN is positive), the target fuel injection amount FN1 is increased, and when the actual revolution speed NE1 exceeds the target revolution speed NR1 (i.e., when the revolution speed deviation ΔN becomes negative), the target fuel injection amount FN1 is decreased, i.e., such that the deviation ΔN of the actual revolution speed NE1 from the target revolution speed NR1 becomes 0. The fuel injection amount is thereby controlled so as to make the actual revolution speed NE1 matched with the target revolution speed NR1. As a result, the engine revolution speed is controlled as isochronous control in which a certain value of the target revolution speed NR1 is obtained in spite of load changes, and hence constant revolution is maintained in a static way at an intermediate load.

The engine torque margin rate computing unit 80*g* computes the engine torque margin rate ENGTRRT by referring to a table, which is stored in a memory, based on the target fuel injection amount FN1. As described above, the engine torque margin rate ENGTRRT means an index value of an engine load rate representing what value the current load rate of the engine 10 takes.

Figure 8:
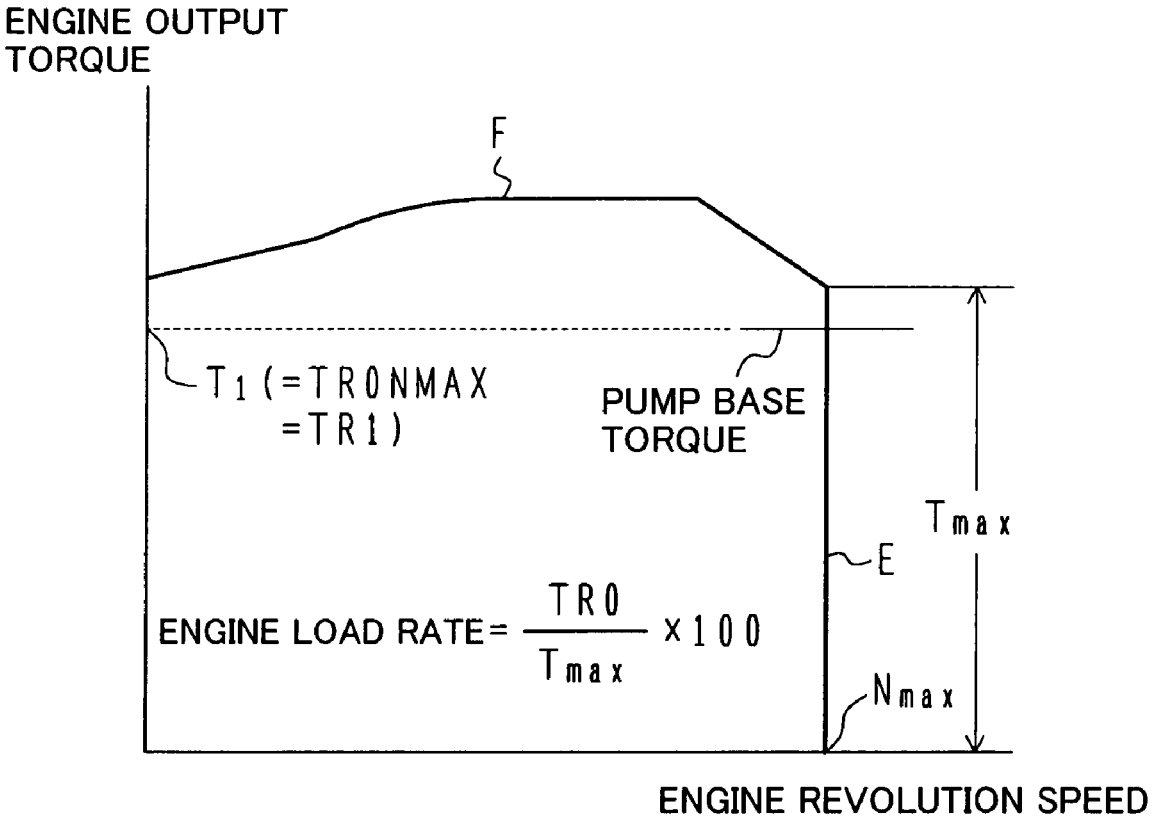
FIG. 8 is a graph showing an output torque characteristic resulting when an engine has a reference output torque characteristic and the environment (including fuel quality) to which the engine is subjected is in a reference condition.

The engine load rate will be described in more detail with reference to FIG. 8. FIG. 8 is a graph showing an output torque characteristic resulting when the engine 10 has a reference output torque characteristic and the environment (including fuel quality) to which the engine 10 is subjected is in a reference condition. The output torque characteristic of the engine 10 is divided into a characteristic E in a regulation region and a characteristic (maximum output characteristic) F in a full load region. The regulation region means a partial load region in which the fuel injection amount of the electronic fuel injector 14 is less than 100%, and the full load region means a maximum output torque region in which the fuel injection amount is 100% (maximum). In this embodiment, since the fuel injector controller 80 performs the isochronous control, the certain revolution speed, e.g., Nmax, is maintained in the regulation region in spite of load changes, and the characteristic E is represented by a linear line perpendicular to the horizontal axis (engine revolution speed). Also, the characteristic E in the regulation region corresponds to, for example, the case in which the target revolution speed NR1 set by the target engine revolution speed input unit 71 is maximum. TR0NMAX represents the pump base torque TR0 resulting when the target revolution speed NR1 is set to a maximum, and as described above it corresponds to the maximum absorption torque T1 of the hydraulic pump 1, 2. TR1 represents the modified pump base torque computed by the pump base torque modifying unit 70*t* at that time. Further, Tmax represents the maximum output torque in the regulation region. The engine load rate is expressed by the following formula:

$$\text{engine load rate}(\%)=(T1/T\text{max})\times 100$$

The engine torque margin rate computing unit 80*g* determines the engine load rate, as the engine torque margin rate ENGTRRT, from the target fuel injection amount FN1. Because of the maximum value of the target fuel injection amount FN1 being decided in advance, if the target fuel injection amount FN1 is at a maximum, the engine torque margin rate ENGTRRT at that time is 100% and the engine load rate is also 100%. If the target fuel injection amount FN1 is, e.g., 50%, the load rate is in the partial load range and the engine torque margin rate ENGTRRT is, e.g., 40%. The relationship between the target fuel injection amount FN1 and the engine torque margin rate ENGTRRT is decided in advance by experiments. Based on the resulting experimental data, the relationship between FN1 and ENGTRRT is set in a table stored in a memory such that as the target fuel injection amount FN1 increases, the engine torque margin rate ENGTRRT is also increased. The present invention is intended to modify the pump base torque using the engine torque margin rate ENGTRRT, and to control the pump maximum absorption torque so that the engine torque margin rate ENGTRRT (engine load rate) is held at a target value.

The relationship between the target fuel injection amount FN1 and the engine torque margin rate ENGTRRT is decided, for example, by a method described below. The method comprises the steps of driving a certain engine, collecting data of output torque for each target fuel injection amount, and properly modifying the output torque depending on status variables, such as a fuel temperature and an atmospheric pressure. Then, assuming that an output torque (maximum output torque) corresponding to the maximum target fuel injection amount at that time is Tmax and an output torque corresponding to each target fuel injection amount is Tx, the engine torque margin rate ENGTRRT (%) is calculated by the following formula:

$$\text{engine torque margin rate ENGTRRT}(\%)=Tx/T\text{max}\times 100$$

The engine torque margin rate ENGTRRT thus calculated is made correspondent to the target fuel injection amount, thereby obtaining the relationship between them.

Next, the feature of the operation of this embodiment thus constructed will be described with reference to FIGS. 9 and 10.

Figure 9:
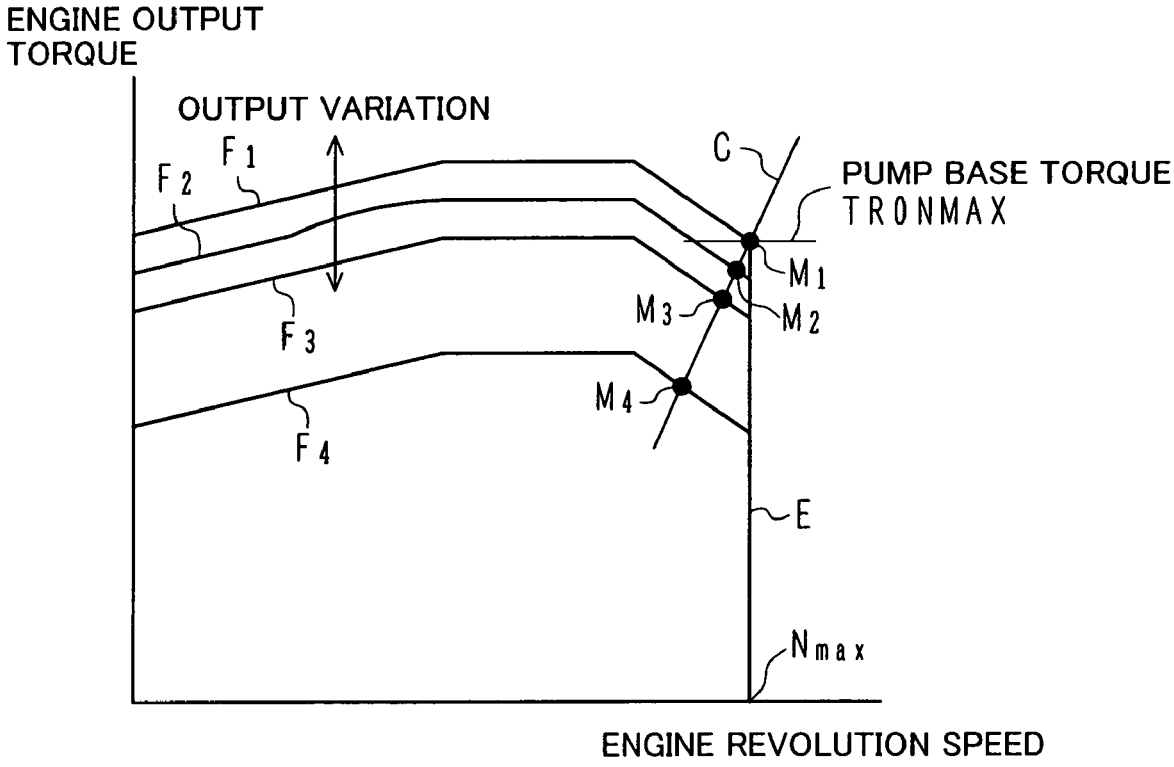
FIG.9 PRIOR ART
FIG. 9 is a graph showing a matching point between engine output torque and pump absorption torque in the known speed sensing control.
Figure 10:
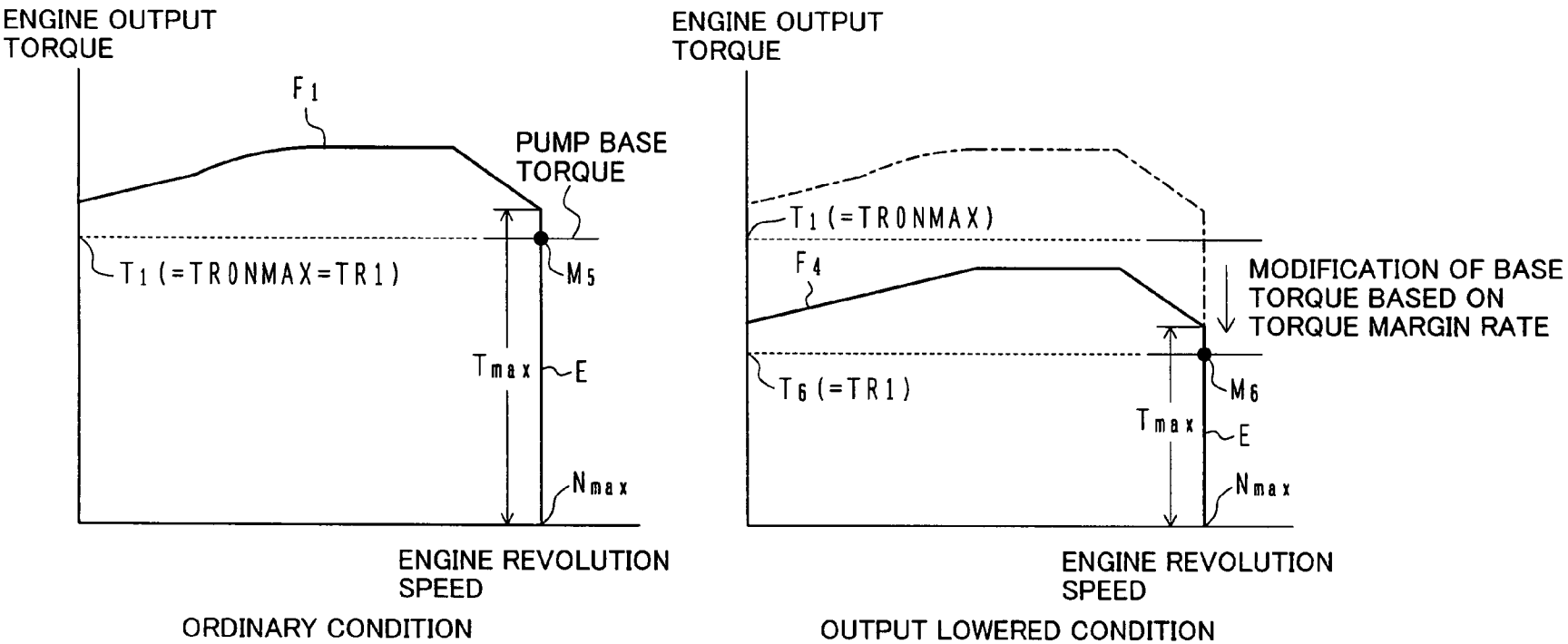
FIG. 10 is a graph showing a matching point between engine output torque and pump absorption torque in pump torque control according to the first embodiment of the present invention.

FIG. 9 is a graph showing a matching point between engine output torque and pump absorption torque in the known pump torque control system, and FIG. 10 is a graph showing a matching point between engine output torque and pump absorption torque in the pump torque control system according to this embodiment. Those matching points are both obtained when the target revolution speed is set to the maximum value. FIG. 9 shows changes of the matching point, in one graph together, resulting when the engine output torque lowers from an ordinary level due to environmental changes or the use of poor fuel. FIG. 10 shows, on the left side, the matching point resulting when the engine output torque is at an ordinary level, and on the right side, the matching point resulting when the engine output torque lowers due to environmental changes or the use of poor fuel.

In FIGS. 9 and 10, characteristics (hereinafter referred to also as "engine output characteristics") F1, F2 and F3 in the full load region represent variations depending on individual products, while a characteristic F4 represents the case in which the output lowers to a large extent due to environmental changes or the use of poor fuel. Furthermore, the characteristic F1 corresponds to the output torque characteristic, shown in FIG. 8, resulting when the engine 10 has the reference output torque characteristic and the environment (including fuel quality) to which the engine 10 is subjected is in the reference condition.

Figure 12:
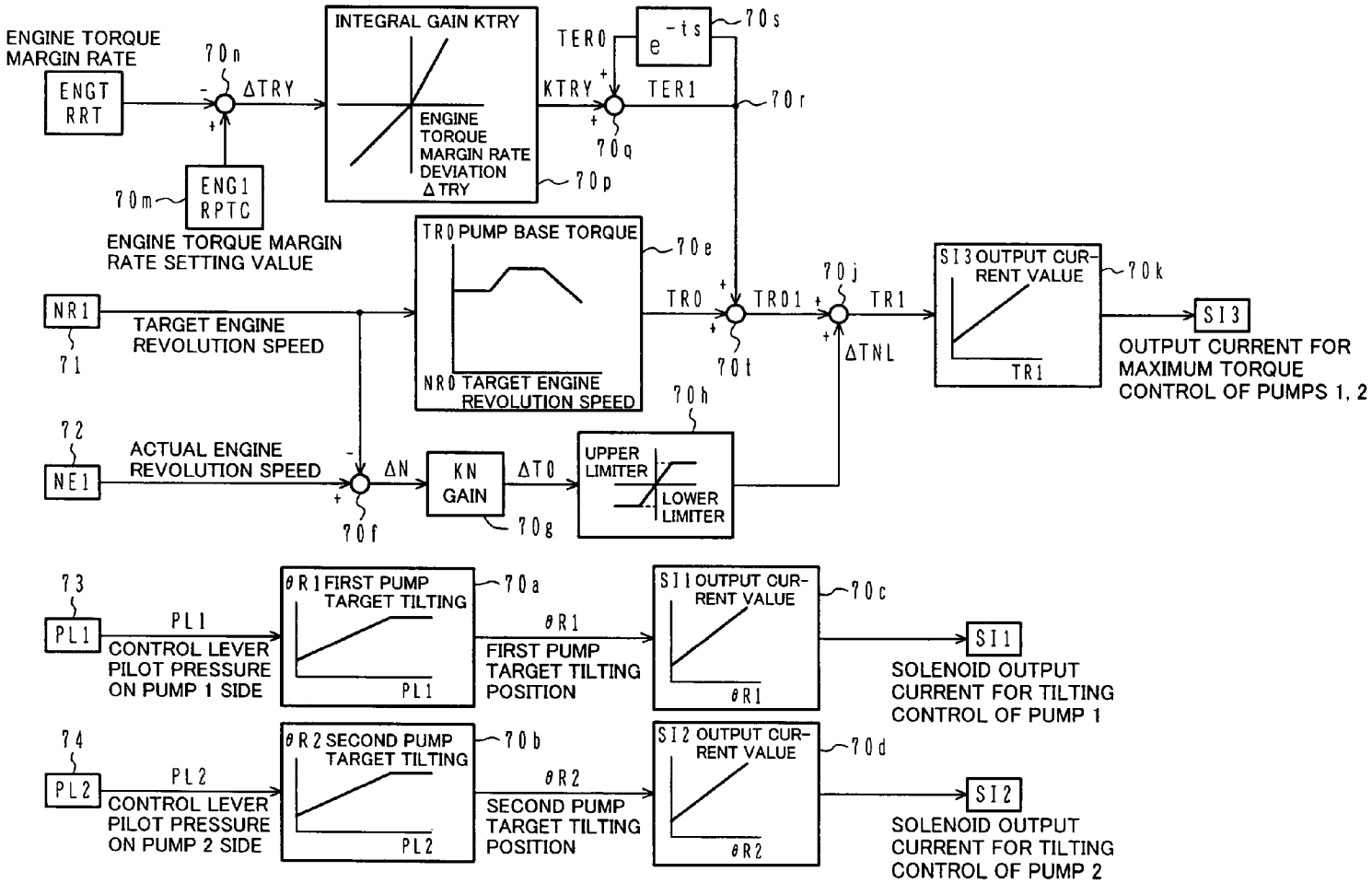
FIG. 12 is a functional block diagram showing processing functions of the machine body controller.

The known pump torque control system performs the speed sensing control. However, that speed sensing control is performed with an arrangement obtained by omitting, from FIG. 12 showing the configuration of a second embodiment described later, an engine torque margin rate setting unit 70*m*, an engine torque margin-rate deviation computing unit 70*n*, a gain computing unit 70*p*, pump torque modification-value computing integral elements 70*q*, 70*r* and 70*s*, and a pump base torque modifying unit 70*t*. Then, a torque modification value ΔTNL for the speed sensing control, which is obtained by a revolution speed deviation computing unit 70*f*, a torque converting unit 70*g*, and a limiter computing unit 70*h*, is added to the pump base torque TR0 in a base torque modifying unit 70*j*, thereby obtaining the absorption torque TR1.

In the known speed sensing control, a pump base torque TR0NMAX is set in a base torque computing unit 70*e* at a value, for example, near the maximum output torque in the regulation region based on the output torque characteristic F1 in the reference condition, taking into account a variation of the engine output. In this case, for an engine having the same characteristic as F1, when the absorption torque of the hydraulic pump 1, 2 (i.e., the engine load) increases and reaches the pump base torque TR0NMAX, the speed sensing control is performed upon a further increase of the pump absorption torque such that the maximum absorption torque of the hydraulic pump 1, 2 is maintained at the pump base torque TR0NMAX. In other words, when the absorption torque of the hydraulic pump 1, 2 (i.e., the engine load) is going to increase beyond the pump base torque TR0NMAX, the engine revolution speed lowers below Nmax and the revolution speed deviation ΔN in the speed sensing control takes a negative value, whereby the maximum absorption torque of the hydraulic pump is decreased and the engine output torque is matched with the pump absorption torque (engine load) obtained by the speed sensing control at a point M1 in the regulation region. It is therefore possible to decrease the maximum absorption torque of the hydraulic pump and to prevent stalling of the engine without a lowering of the engine revolution speed.

When the engine output lowers due to environmental changes, the use of poor fuel or other reasons and the characteristic in the full load region shifts from F1 to F4, the maximum torque matching point by the speed sensing control also shifts from M1 to M4. More specifically, when the maximum output torque in the regulation region based on the engine output characteristic becomes smaller than the pump base torque for the speed sensing control, the speed sensing control is performed to decrease the maximum absorption torque of the hydraulic pump 1, 2 depending on a lowering of the engine revolution speed (i.e., an increase of an absolute value of the revolution speed deviation ΔN (negative value)). At this time, a proportion of a decrease of the pump maximum absorption torque with respect to the lowering of the engine revolution speed (i.e., the increase of the revolution speed deviation ΔN) is decided by a gain KN set in the torque converting unit 70*g* shown in FIG. 11. This gain KN is called a speed sensing gain for the pump maximum absorption torque, and it corresponds to "C" in FIG. 9. Therefore, the maximum absorption torque of the hydraulic pump 1, 2 is decreased following a characteristic of the speed sensing gain C depending on the lowering of the engine revolution speed, and the matching point shifts from M1 to M4 correspondingly. As a result, engine stalling can be prevented even when the engine output lowers to a large extent due to environmental changes, the use of poor fuel or other reasons. Further, because the matching point M4 between the engine output torque and the pump torque shifts from the regulation region to the full load region at the same time, the engine revolution speed lowers from the target revolution speed. Accordingly, whenever such a shift occurs during work in which the load condition changes to a high-load condition, e.g., work of excavating earth and sand, the engine revolution speed lowers, thus generating noise and making an operator feel unpleasant or fatigue.

For engines having output characteristics changed as indicated by F2, F3 depending on variations in performance of individual products, the matching point similarly shifts to M2 or M3 in the full load region, thus resulting in a lowering of the engine revolution speed.

Further, generally, maximum output horsepower of an engine is obtained at its maximum revolution speed, i.e., near a crossed point between the characteristic E in the regulation region and one of the characteristics F1-F4 in the full load region. Accordingly, if the matching point shifts to M2, M3 or M4, the engine output horsepower cannot be utilized with maximum efficiency.

In this embodiment, as described above, the pump maximum absorption torque is controlled so that the engine torque margin rate ENGTRRT (engine load rate) is held at the target value. Such control is performed, as shown in FIG. 10, for the engine having the characteristic F1. When the absorption torque of the hydraulic pump 1, 2 (i.e., the engine load) increases and reaches the pump base torque TR0NMAX, the engine torque margin rate also reaches the setting value (99%) in the engine torque margin rate setting unit 70*m*. However, when the pump absorption torque (engine load) further increases and the engine torque margin rate exceeds the setting value (99%), the engine torque margin-rate deviation computing unit 70*n* computes the deviation ΔTRY as a minus value and the pump base torque modification value TER1 takes a minus value. Correspondingly, the pump base torque modifying unit 70*t* computes, as the pump base torque TR1, a value obtained by subtracting an absolute value of the pump base torque modification value TER1 from the pump base torque TR0 (=TR0NMAX). In other words, a relationship of TR1<TR0NMAX is held. The pump base torque TR1 is the target value of the pump maximum absorption torque, and the absorption torque of the hydraulic pump 1, 2 (i.e., the engine load) is decreased from the pump base torque TR0NMAX to TR1. As a result, the engine torque margin rate returns to the setting value (99%) and the deviation ΔTRY becomes 0, whereby the pump base torque modification value TER1 also becomes 0 and the pump base torque TR1 is maintained at TR0NMAX. Thus, the engine output torque and the pump absorption torque are matched with each other at a point M5 in the regulation region. It is hence possible to decrease the maximum absorption torque of the hydraulic pump and to prevent stalling of the engine without a lowering of the engine revolution speed.

For the engine in which the engine output lowers due to environmental changes, the use of poor fuel or other reasons and the characteristic in the full load region shifts from F1 to F4, when the absorption torque of the hydraulic pump 1, 2 (i.e., the engine load) increases, the engine torque margin rate reaches the setting value (99%) in the engine torque margin rate setting unit 70*m* before the pump absorption torque reaches the pump base torque TR0NMAX. When the engine torque margin rate exceeds the setting value (99%), the engine torque margin-rate deviation computing unit 70*n* computes the deviation ΔTRY as a minus value and the pump base torque modification value TER1 takes a minus value. Correspondingly, the pump base torque modifying unit 70*t* computes, as the pump base torque TR1, a value obtained by subtracting an absolute value of the pump base torque modification value TER1 from the pump base torque TR0 (=TR0NMAX), whereby the absorption torque of the hydraulic pump 1, 2 (i.e., the engine load) is decreased from the pump base torque TR0NMAX to TR1. In this case, because the engine output lowers, the engine torque margin rate still remains in excess of the setting value (99%) even after a slight decrease of the pump absorption torque. Therefore, the deviation ΔTRY is continuously computed as a minus value and the pump base torque TR1 continues to decrease. In other words, a decrease of the pump base torque TR1 continues until the engine torque margin rate returns to the setting value (99%). When the pump absorption torque (engine load) further decreases with a continuing decrease of the pump base torque TR1 and the engine torque margin rate returns to the setting value (99%), the deviation ΔTRY becomes 0, whereby the pump base torque modification value TER1 also becomes 0 and the pump base torque TR1 is maintained at a value below TR0NMAX. T6 in FIG. 10 represents the maximum absorption torque of the hydraulic pump 1, 2 corresponding to the pump base torque TR1. Stated another way, the control is performed such that a ratio between the maximum output torque Tmax of the engine and the pump base torque TR1 (=T5) is held at the setting value of the engine torque margin rate, and that the engine output torque and the pump absorption torque are matched with each other at a point M6 in the regulation region at a level lower than the pump base torque TR0NMAX. As a result, even when the engine output lowers due to environmental changes, the use of poor fuel or other reasons and the characteristic in the full load region shifts from F1 to F4, it is possible to decrease the maximum absorption torque of the hydraulic pump and to prevent stalling of the engine without a lowering of the engine revolution speed.

For engines having output characteristics changed as indicated by F2, F3 in FIG. 9 depending on variations in performance of individual products, since the control is similarly performed such that the ratio between the maximum output torque Tmax of the engine and the pump base torque TR1 is held at the setting value of the engine torque margin rate, the matching point is located in the regulation region at a level lower than the pump base torque TR0NMAX. As a result, it is possible to decrease the maximum absorption torque of the hydraulic pump and to prevent stalling of the engine without a lowering of the engine revolution speed.

Further, since the matching point is located in the regulation region at a level lower than the pump base torque TR0NMAX, the matching point exists near the crossed point between the characteristic E in the regulation region and one of the characteristics F1-F4 in the full load region by selecting the setting value of the engine torque margin rate to a value near 100%. Accordingly, the maximum output horsepower of the engine can be effectively utilized.

With this embodiment, as described above, the engine stalling can be prevented by decreasing the maximum absorption torque of the hydraulic pump under the high-load condition. In addition, even when the engine output lowers due to environmental changes, the use of poor fuel or other reasons, the maximum absorption torque of the hydraulic pump can be decreased without a lowering of the engine revolution speed.

Moreover, because of the control holding the engine load rate at the target value, the control is performed regardless of a factor causing the lowering of the engine output such that, when the maximum output torque in the regulation region lowers, the maximum absorption torque of the hydraulic pump, i.e., the load, can also be automatically decreased. Therefore, this embodiment is adaptable for the lowering of the engine revolution speed caused by factors that cannot be predicted in advance or are difficult to detect by sensors. Additionally, because of no necessity of sensors, such as environment sensors, the manufacturing cost can be reduced.

Furthermore, the maximum output horsepower of the engine can be effectively utilized.

A second embodiment of the present invention will be described below with reference to FIGS. 11 and 12. In these drawings, similar components to those shown in FIGS. 5 and 6 are denoted by the same symbols. In this embodiment, the speed sensing control is combined with the pump torque control of the present invention.

Figure 11:
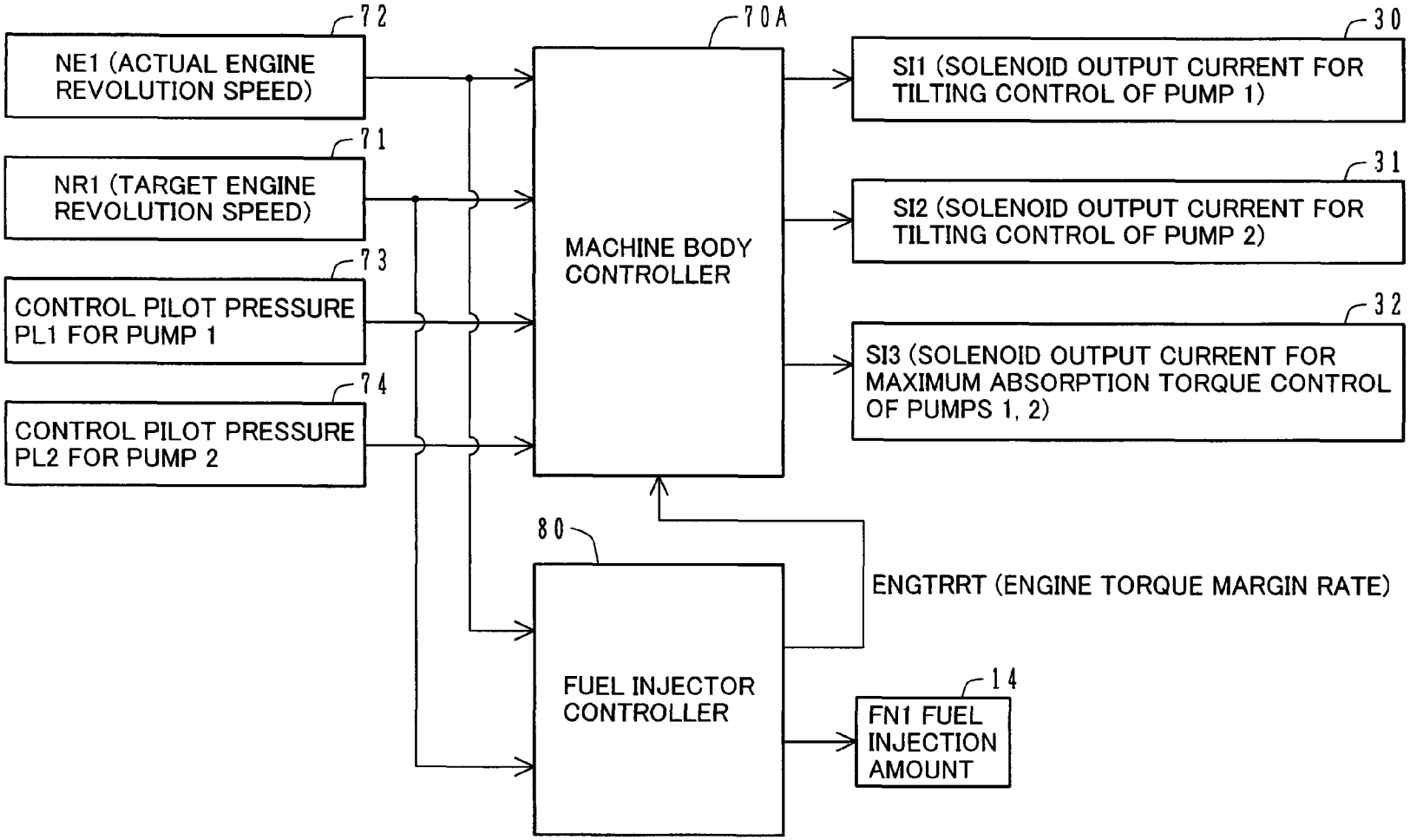
FIG. 11 is a block diagram showing controllers (i.e., a machine body controller and an engine fuel injector controller), which constitute an arithmetic control section of an engine/pump control unit according to a second embodiment of the present invention, and input/output relationships of those controllers.

FIG. 11 is a block diagram showing input/output relationships of all signals to and from a machine body controller 70A and an engine fuel injector controller 80.

The machine body controller 70A receives not only a signal indicating the target revolution speed NR1, signals indicating the pump control pilot pressures PL1, PL2 from the pressure sensors 73, 74, and a signal indicating the engine torque margin rate ENGTRRT, but also a signal indicating the actual revolution speed NE1 from the revolution speed sensor 72. After executing predetermined arithmetic processing based on those input signals, the machine body controller 70A outputs the drive currents SI1, SI2 and SI3 to the solenoid control valves 30-32. The input/output signals to and from the engine fuel injector controller 80 are the same as those in the first embodiment shown in FIG. 5.

FIG. 12 is a block diagram showing processing functions in the control of the hydraulic pumps 1, 2 executed by the machine body controller 70A.

In FIG. 12, the machine body controller 70A has various functions executed by not only pump target tilting computing units 70*a*, 70*b*, solenoid output current computing units 70*c*, 70*d*, a base torque computing unit 70*e*, an engine torque margin rate setting unit 70*m*, an engine torque margin-rate deviation computing unit 70*n*, a gain computing unit 70*p*, pump torque modification-value computing integral elements 70*q*, 70*r* and 70*s*, a pump base torque modifying unit 70*t*, and a solenoid output current computing unit 70*k*, but also a revolution speed deviation computing unit 70*f*, a torque converting unit 70*g*, a limiter computing unit 70*h*, and a second base torque modifying unit 70*j*.

The revolution speed deviation computing unit 70*f* computes a difference between the target revolution speed NR1 and the actual revolution speed NE1, i.e., a revolution speed deviation ΔN (=NE1−NR1).

The torque converting unit 70*g* multiplies the revolution speed deviation ΔN by a gain KN for the speed sensing control to compute a speed sensing torque deviation ΔT0.

The limiter computing unit 70*h* multiplies the speed sensing torque deviation ΔT0 by upper and lower limiters to obtain a torque modification value ΔTNL for the speed sensing control.

The second pump base torque modifying unit 70*j* adds the torque modification value ΔTNL for the speed sensing control pump base torque modification value TER1 to the pump base torque TR01 obtained after modification by the pump base torque modifying unit 70*t*, thereby computing a modified pump base torque TR1 (=TR01+ΔTNL). This modified pump base torque is used as a target value of the pump maximum absorption torque.

This embodiment thus constructed can provide the following advantage in addition to similar advantages to those obtainable with the first embodiment. Since the speed sensing control for controlling the pump maximum absorption based on the revolution speed deviation is always performed in a combined manner, the engine can be prevented from stalling with a good response even for a lowering of the engine output caused by application of an abrupt load or an unexpected event.

In the embodiments described above, isochronous control for maintaining the engine revolution speed constant in spite of load changes is performed as the control executed by the electronic fuel injector 14 in the regulation region. However, the present invention is also applicable to a system performing the control based on the so-called droop characteristic in which the engine revolution speed reduces as the engine output increases. This case can also provide similar advantages to those obtainable with the above-described embodiments performing the isochronous control.

INDUSTRIAL APPLICABILITY

According to the present invention, the engine stalling can be prevented by decreasing the maximum absorption torque of the hydraulic pump under the high-load condition. When the engine output lowers due to environmental changes, the use of poor fuel or other reasons, the maximum absorption torque of the hydraulic pump can be decreased without a lowering of the engine revolution speed. Further, the present invention is adaptable for any kinds of factors causing a lowering of the engine output, such as those factors that cannot be predicted in advance or are difficult to detect by sensors. In addition, because of no necessity of sensors, such as environment sensors, the manufacturing cost can be reduced.

The invention claimed is:

1. A pump torque control method for a hydraulic construction machine comprising an engine, a fuel injector for controlling a revolution speed and an output of said engine, a fuel injector controller for computing a target fuel injection amount and controlling said fuel injector based on the target fuel injection amount, and at least one variable displacement hydraulic pump driven by said engine and driving actuators, wherein the control method comprises the steps of:

driving a certain engine and collecting data of output torque for each target fuel injection amount in a reference condition, calculating an engine torque margin rate by the following formula from said output torque data, and then determining a relationship between said target fuel injection amount and said engine torque margin rate in advance of operation;

$$\text{engine torque margin rate}(\%)=Tx/T\max*100,$$

wherein

Tx represents an output torque of the engine corresponding to each of target fuel injection amounts, and Tmax represents a maximum output torque of the engine corresponding to a maximum target fuel injection amount computing a current engine torque margin rate of said engine by referring the target fuel injection amount computed by said fuel injector controller to said relationship; and comparing the current engine torque margin rate with a target value of said engine torque margin rate preset as a value smaller than 100% and reducing a maximum absorption torque of said hydraulic pump when said current engine torque margin rate exceeds the preset target value thereby to control the maximum absorption torque of said hydraulic pump to return said current engine torque margin rate to the preset target value.

2. A pump torque control method for a hydraulic construction machine according to claim 1, wherein the step of controlling the maximum absorption torque is performed by computing a deviation of the current engine torque margin rate of the engine from the target value thereof, modifying a pump base torque based on the computed deviation, and controlling the maximum absorption torque of said hydraulic pump to be matched with a modified pump base torque.

3. A pump torque control method for a hydraulic construction machine according to claim 1, wherein the control method further comprises the steps of, at the same time as controlling the maximum absorption torque of said hydraulic pump so that the current engine torque margin rate of the engine is held at the target value thereof, computing a deviation of an actual revolution speed from a target revolution speed of said engine, and controlling the maximum absorption torque of said hydraulic pump so that the deviation reduces.

4. A pump torque control system for a hydraulic construction machine comprising an engine, a fuel injector for controlling a revolution speed and an output of said engine, a fuel injector controller for computing a target fuel injection amount and controlling said fuel injector based on the target fuel injection amount, and at least one variable displacement hydraulic pump driven by said engine and driving actuators, wherein the control system further comprises:

first means for determining a relationship between said target fuel injection amount and an engine torque margin rate and computing a current engine torque margin rate of said engine by referring the target fuel injection amount computed by said fuel injector controller to said relationship; and second means for comparing the current engine torque margin rate with a target value of said engine torque margin rate preset as a value smaller than 100% and reducing a maximum absorption torque of said hydraulic pump when said current engine torque margin rate exceeds the preset target value thereby to control the maximum absorption torque of said hydraulic pump to return said current engine torque margin rate to the preset target value, and wherein said relationship between said target fuel injection amount and said engine torque margin rate is determined by driving a certain engine and collecting data of output torque for each target fuel injection amount in a reference condition, calculating said engine torque margin rate by the following formula from said output torque data, and then obtaining the relationship between said target fuel injection amount and said engine torque margin rate in advance of operation;

$$\text{engine torque margin rate}(\%)=Tx/T\text{max}*100,$$

wherein

Tx represents an output torque of the engine corresponding to each of target fuel injection amounts, and Tmax represents a maximum output torque of the engine corresponding to a maximum target fuel injection amount.

5. A pump torque control system for a hydraulic construction machine according to claim 4, wherein said second means computes a deviation of the current engine torque margin rate of the engine from the target value thereof, modifies a pump base torque based on the computed deviation, and controls the maximum absorption torque of said hydraulic pump to be matched with a modified pump base torque.

6. A pump torque control system for a hydraulic construction machine according to claim 5, wherein said second means integrates the deviation to determine a pump base torque modification value, and add the determined pump base torque to the pump base torque, thereby modifying the pump base torque.

7. A pump torque control system for a hydraulic construction machine according to claim 4, wherein the control system further comprises third means for computing a deviation of an actual revolution speed from a target revolution speed of said engine, and controlling the maximum absorption torque of said hydraulic pump so that the deviation reduces.

* * * * *